US008821076B2

(12) United States Patent
Tyler

(10) Patent No.: US 8,821,076 B2
(45) Date of Patent: Sep. 2, 2014

(54) DEVICES, SYSTEMS AND METHODS FOR CONTROLLING EROSION

(75) Inventor: Rodney W. Tyler, Medina, OH (US)

(73) Assignee: Conwed Plastics Acquisition Company V LLC, Minneapolis, MN (US)

( * ) Notice: Subject to any disclaimer, the term of this patent is extended or adjusted under 35 U.S.C. 154(b) by 0 days.

(21) Appl. No.: 11/804,163

(22) Filed: May 17, 2007

(65) Prior Publication Data

US 2007/0224004 A1 Sep. 27, 2007

Related U.S. Application Data

(62) Division of application No. 10/208,631, filed on Jul. 29, 2002, now Pat. No. 7,226,240.

(60) Provisional application No. 60/309,054, filed on Jul. 31, 2001.

(51) Int. Cl.
*E02B 3/12* (2006.01)

(52) U.S. Cl.
CPC ..... *E02B 3/127* (2013.01)
USPC ..... 405/302.6; 405/19

(58) Field of Classification Search
USPC ..... 405/107, 111, 114, 115, 302.4, 302.6; 383/904, 906
See application file for complete search history.

(56) References Cited

U.S. PATENT DOCUMENTS 2,071,779 A 3/1937 Willing
2,201,279 A 5/1940 Willing
2,605,589 A 8/1952 Kuestner
2,757,841 A 8/1956 Chapman
2,842,297 A 7/1958 Friedman
2,842,897 A 7/1958 Finn
2,916,854 A 12/1959 Heigl
3,214,866 A * 11/1965 Halleck ..... 47/58.1 R
3,315,408 A 4/1967 Fisher
3,320,696 A * 5/1967 Wright et. al. ..... 47/9
3,362,106 A 1/1968 Goldring
3,375,607 A 4/1968 Melvold
3,597,928 A * 8/1971 Pilaar ..... 405/20
3,617,566 A 11/1971 Oshima
3,726,488 A * 4/1973 Aasland et al. ..... 241/101.78
3,861,603 A * 1/1975 Lautzenheiser et al. ..... 241/100
3,957,098 A * 5/1976 Hepworth et al. ..... 383/45
3,979,146 A 9/1976 Berg
4,044,525 A 8/1977 Forsgren
4,089,179 A 5/1978 Trautman
4,297,810 A * 11/1981 Hansford ..... 47/9
4,405,257 A * 9/1983 Nielsen ..... 405/19
4,449,847 A * 5/1984 Scales et al. ..... 405/19

(Continued)

OTHER PUBLICATIONS

Albright Seed Company, "Construction Site Erosion Costly, Illegal", Jan. 1, 1997, 1-3, Streamline Publications, US.

(Continued)

*Primary Examiner* — Tara M. Pinnock
(74) *Attorney, Agent, or Firm* — Michael Haynes PLC; Michael N. Haynes

(57) ABSTRACT

At least one exemplary device includes a tubular mesh enclosure formed from a mesh material having a nominal opening size of less than 0.5 inches, a ratio of a length of the mesh enclosure to a diameter of the mesh enclosure greater than 40, having an opposing pair of ends, at least one of the ends sealed, the enclosure surrounding a filling.

22 Claims, 2 Drawing Sheets

(56) References Cited

U.S. PATENT DOCUMENTS

| | | | | | |
|---|---|---|---|---|---|
| 4,650,368 | A | * | 3/1987 | Bayer | 405/111 |
| 4,729,691 | A | | 3/1988 | Sample | |
| 4,788,936 | A | * | 12/1988 | Billings | 119/171 |
| 4,799,821 | A | * | 1/1989 | Brodersen | 405/115 |
| 4,934,094 | A | | 6/1990 | Walton | |
| 5,015,123 | A | | 5/1991 | Houck | |
| 5,030,031 | A | * | 7/1991 | Brown | 405/36 |
| 5,108,224 | A | | 4/1992 | Cabaniss | |
| 5,137,219 | A | * | 8/1992 | Morey | 241/92 |
| 5,154,543 | A | * | 10/1992 | Houck et al. | 405/303 |
| 5,205,068 | A | | 4/1993 | Solomou | |
| 5,226,255 | A | * | 7/1993 | Robertson | 47/56 |
| 5,309,673 | A | | 5/1994 | Stover | |
| 5,310,288 | A | | 5/1994 | Huang | |
| 5,345,713 | A | | 9/1994 | Molnar | |
| 5,358,356 | A | * | 10/1994 | Romanek et al. | 405/16 |
| 5,381,970 | A | * | 1/1995 | Bold et al. | 241/55 |
| 5,405,217 | A | | 4/1995 | Dias | |
| 5,456,733 | A | * | 10/1995 | Hamilton, Jr. | 47/9 |
| 5,465,527 | A | | 11/1995 | Able | |
| 5,481,827 | A | * | 1/1996 | Decker | 47/58.1 R |
| 5,507,845 | A | | 4/1996 | Molnar | |
| 5,519,985 | A | | 5/1996 | Dyck | |
| 5,538,860 | A | | 7/1996 | Castelli | |
| 5,555,674 | A | | 9/1996 | Molnar | |
| 5,570,973 | A | | 11/1996 | Hunt | |
| 5,595,458 | A | | 1/1997 | Grabhorn | |
| 5,597,732 | A | | 1/1997 | Bryan-Brown | |
| 5,605,416 | A | | 2/1997 | Roach | |
| 5,658,096 | A | | 8/1997 | Von Kanel | |
| 5,669,732 | A | * | 9/1997 | Truitt | 405/20 |
| 5,674,806 | A | * | 10/1997 | Adamoli et al. | 504/358 |
| 5,678,954 | A | | 10/1997 | Bestmann | |
| 5,679,247 | A | | 10/1997 | Burke | |
| 5,683,810 | A | * | 11/1997 | Babbitt et al. | 428/370 |
| 5,718,802 | A | * | 2/1998 | Collier et al. | 162/21 |
| 5,733,067 | A | | 3/1998 | Hunt | |
| 5,735,982 | A | * | 4/1998 | Prunty et al. | 156/62.2 |
| 5,747,633 | A | | 5/1998 | Ito | |
| 5,802,763 | A | | 9/1998 | Milstein | |
| 5,806,445 | A | * | 9/1998 | Decker | 111/200 |
| 5,824,725 | A | * | 10/1998 | Lahalih | 405/264 |
| 5,854,304 | A | | 12/1998 | Garcia | |
| 5,860,770 | A | | 1/1999 | Hunt | |
| 5,906,436 | A | | 5/1999 | Cole | |
| 5,934,027 | A | | 8/1999 | Khalili | |
| 5,983,561 | A | | 11/1999 | Behrens | |
| 5,988,942 | A | | 11/1999 | Atkinson | |
| 6,027,054 | A | * | 2/2000 | Kaye et al. | 241/33 |
| 6,029,395 | A | * | 2/2000 | Morgan | 47/9 |
| 6,042,305 | A | * | 3/2000 | Novich et al. | 405/266 |
| 6,085,810 | A | * | 7/2000 | Castillo et al. | 141/391 |
| 6,109,835 | A | | 8/2000 | Grabhorn | |
| 6,113,789 | A | | 9/2000 | Burke | |
| 6,135,672 | A | | 10/2000 | Davidson | |
| 6,155,749 | A | * | 12/2000 | Tanner et al. | 405/258.1 |
| 6,171,984 | B1 | * | 1/2001 | Paulson et al. | 442/331 |
| 6,247,876 | B1 | * | 6/2001 | Stephens | 406/39 |
| 6,281,001 | B1 | | 8/2001 | McNelly | |
| 6,286,253 | B1 | * | 9/2001 | Decker | 47/56 |
| 6,343,897 | B1 | * | 2/2002 | Cutler | 406/143 |
| 6,357,971 | B1 | * | 3/2002 | Rexius | 406/43 |
| 6,527,477 | B1 | | 3/2003 | Allard | |
| 6,547,493 | B2 | | 4/2003 | Spangler | |
| 6,627,434 | B1 | | 9/2003 | McNelly | |
| 6,641,335 | B1 | | 11/2003 | Allard | |
| 6,658,790 | B2 | | 12/2003 | Skuba | |
| 6,709,202 | B2 | | 3/2004 | Spangler | |
| 6,733,209 | B2 | | 5/2004 | Allard | |
| 6,824,681 | B2 | | 11/2004 | Engwer | |
| 6,910,835 | B2 | | 6/2005 | Spangler | |
| 6,913,423 | B2 | | 7/2005 | Spangler | |
| 6,921,484 | B2 | | 7/2005 | Engwer | |
| 6,951,438 | B2 | | 10/2005 | Carpenter | |
| 7,029,208 | B1 | | 4/2006 | Santha | |
| 2001/0053545 | A1 | * | 12/2001 | Engwer | 435/262 |
| 2002/0146394 | A1 | | 10/2002 | Stamets | |
| 2003/0000139 | A1 | | 1/2003 | Anderson | |
| 2006/0236603 | A1 | | 10/2006 | Egan | |
| 2006/0257212 | A1 | | 11/2006 | Kim | |
| 2006/0280562 | A1 | | 12/2006 | Marxen | |
| 2006/0291963 | A1 | | 12/2006 | Theisen | |

OTHER PUBLICATIONS

Bentjcn, "Bioremediation and Phytoremediation Glossary", [http://members.tripod.com/~bioremediation/], Jan. 1, 1998.

California Integrated Wast Management Board, "Erosion Control", [http://www.ciwmb.ca.gov/Organics/Erosion/], Jan. 1, 2001, California Integrated Wast Management Board.

Glass, "U.S. and International Markets for Phytoremediation, 1999-2000", [http://www.channel1.com/dglassassoc/INFO/phy99exe.htm], Jan. 1, 1999, D. Glass Associates, Inc.

Huffman, "Phytoremediation", [http://www.woodrow.org/teachers/bi/1998/bioremediation/], Jan. 1, 1998, WWLPT Biology Institute.

Keating, "Compost Coverage", May 1, 2001, pp. 30-35, Erosion Control.

Keating, "Seeding: Success is all in the Techniques", Jan. 1, 2002, pp. 46, 48-52, Erosion Control.

Land and Water, "Land and Water", Mar. 1, 2002, pp. 1-72, Land and Water, Fort Dodge, IA, US.

Lenhart, "The Stormwater Management StormFilter", Jan. 1, 1997, pp. 252-258, Stormwater Management, US.

Missouri Botanical Garden, "Phytoremediation", [http://www.mobot.org/jwcross/phytoremediation/phytorem_reviews.htm], Jan. 1, 2001, Missouri Botanical Garden.

Rock, "Phytoremediation", Seminar Series on Bioremediation of Hazardous Waste Sites: Practical Approaches to Implementation, Jan. 1, 1998, 8-1-8-9.

Tyler. "Compost's Next Wave", May 1, 2002. p. 34, Waste Age.

American Society for Testing and Materials, "Standard Specification for Wire Cloth and Sieves for Testing Purposes", 1995, 5 page(s), ASTM Int'l.

Federal Supply Service, "Federal Specification: Cloth, Burlap, Jute (or Kenaf); CCC-C467C", Feb. 8, 1972, 10 page(s), U.S. Federal Supply Service, General Service Administration, USA.

GDOT, "Standard Specifications Construction of Transportation Systems, 2001 edition: Section 201 Clearing and Grubbing Right of Way", Jun. 21, 2001, 6 page(s).

GDOT, "Standard Specifications Construction of Transportation Systems, 2001 edition: Section 881-Fabrics", Jun. 21, 2001, 9 page(s).

HydraulicSupermarket.com, "Velocity and Pressure Drops in Pipes", 2000, 5 page(s), HydraulicSupermarket.com.

USDA, "Planning and Design Manual for the Control of Erosion, Sediment, and Stormwater: Chaper 4: Best Management Practice Standards—Silt Fence", Apr. 1, 1994, 9 page(s), http://www.abe.msstate.edu/csd/p-dm/.

Washington State University, "Pipe Pressure Loss Calculator", 2001, 1 page(s), available at http://irrigation.wsu.edu/pipefriction.php.

BioCycle, "The Art & Science of Composting", Jan. 1, 1991, 5 page(s), JG Press, Inc.

CCREF/USCC, "Compost Use on State Highway Applications", Dec. 20, 2002, 4 page(s), Composting Council Research and Education Foundation; United States Composting Council.

Composting Council, "Field Guide to Compost Use", Jan. 1, 1996, Composting Council.

Electronic Code of Federal Regulations, "Title 40: Protection of Environment; Part 503", Feb. 19, 1993, 50 page(s), e-CFR—Electronic Code of Federal Regulations.

EPA, "An Analysis of Composting as an Environmental Remediation Technology", Apr. 1, 1998, 116 page(s), United States Environmental Protection Agency.

EPA, "Innovative Uses of Compost: Bioremediation and Pollution Prevention", Oct. 1, 1997, 6 page(s), United States Environmental Protection Agency.

(56) References Cited

OTHER PUBLICATIONS

EPA, "Innovative Uses of Compost: Erosion Control, Turf Remediation, and Landscaping", Oct. 1, 1997, 8 page(s), United States Environmental Protection Agency.
EPA, "Organic Materials FactSheet: For everyone—from government agencies to entrepreneurs to homeowners", May 1, 2000, 6 page(s), United States Environmental Protection Agency.
Giles, "Fluid Mechanics & Hydraulics", Jan. 1, 1962, 19 page(s), McGraw-Hill, Inc.
Hallee, "Composting Cull Potatoes", Apr. 1, 1997, 4 page(s), University of Maine Cooperative Extension.
NRAES, "Composting for Municipalities", Nov. 1, 1998, p. 113, National Resource, Agriculture, and Engineering Service.
Barker, "Compost Utilization in Sod Production and Turf Management", Jan. 1, 2001, 25 pages, CRC Press LLC.
Brinton, "Compost Quality Standards & Guidelines", Dec. 1, 2000, 44 pages, Woods End Research Laboratory, Inc.
Sullivan, "Compost Quality Attributes, Measurements, and Variability", Jan. 1, 2001, 26 pages, CRC Press LLC.
Walker, "U.S. Environmental Protection Agency Regulations Governing Compost Production and Use", Jan. 1, 2001, 19 pages, CRC Press LLC.

* cited by examiner

DEVICES, SYSTEMS AND METHODS FOR CONTROLLING EROSION

This application is a Divisional of, claims priority to, and incorporates herein by reference in its entirety, U.S. patent application Ser. No. 10/208,631, filed 29 Jul. 2002, now U.S. Pat. No. 7,226,240, and claims priority to, and incorporates herein by reference in its entirety U.S. Provisional Patent Application Ser. No. 60/309,054, titled "Device, System, and Method for Controlling Erosion", filed 31 Jul. 2001.

BRIEF DESCRIPTION OF THE DRAWINGS

Certain embodiments of the invention will be more readily understood through the following detailed description, with reference to the accompanying drawings, in which.

DETAILED DESCRIPTION

The present invention generally relates to devices, systems, and methods, embodiments of some of which can be useful for controlling erosion, retaining sediment, preventing siltation, treating runoff, removing pollutants, remediating environmental damage, protecting plants, bordering play areas, absorbing spills, establishing vegetation, protecting ecosystems, and/or restoring waterways and/or other riparian areas.

Certain exemplary embodiments of the present invention include a system that can include mesh tubes and/or enclosures that are filled with any of a variety of materials, including compost, composted products, mulch, sawdust, soil, gravel, and/or various other organic and/or inorganic substances. Such filled tubes can be filled on-site, which can reduce the transportation cost of the systems. Moreover, such filled tubes can be relatively heavy, thereby avoiding floating away in heavy rain.

Certain embodiments of such filled tubes can be used in a variety of ways such as on an erosion-prone slope, across a small drainage ditch, or surrounding a drain. The tubes can be held in place by their own weight and/or by stakes, which can be driven through the tubes and into the ground. In certain embodiments, attached to the tubes can be additional anchoring mesh, through which anchors can be driven to secure the tubes to the ground.

Certain exemplary embodiments of the present invention include a method for filling and placing the compost-filed tubes on-site. The tubes can be filled using a pneumatic blower truck, an auger, and/or by hand.

System 1000

Figure 1:
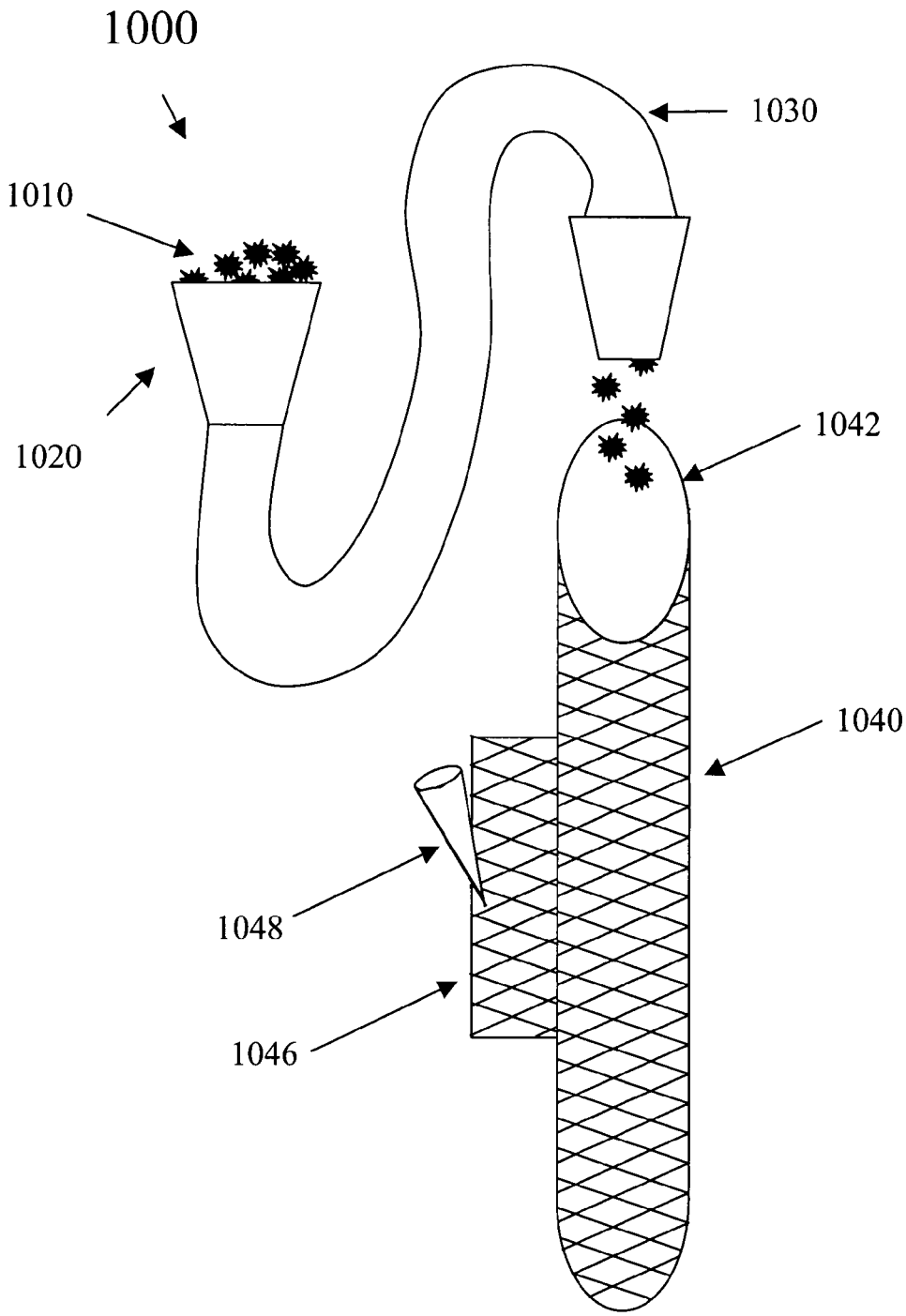
FIG. 1 is a block diagram of an embodiment of a system 1000 of the present invention.
Figure 2:
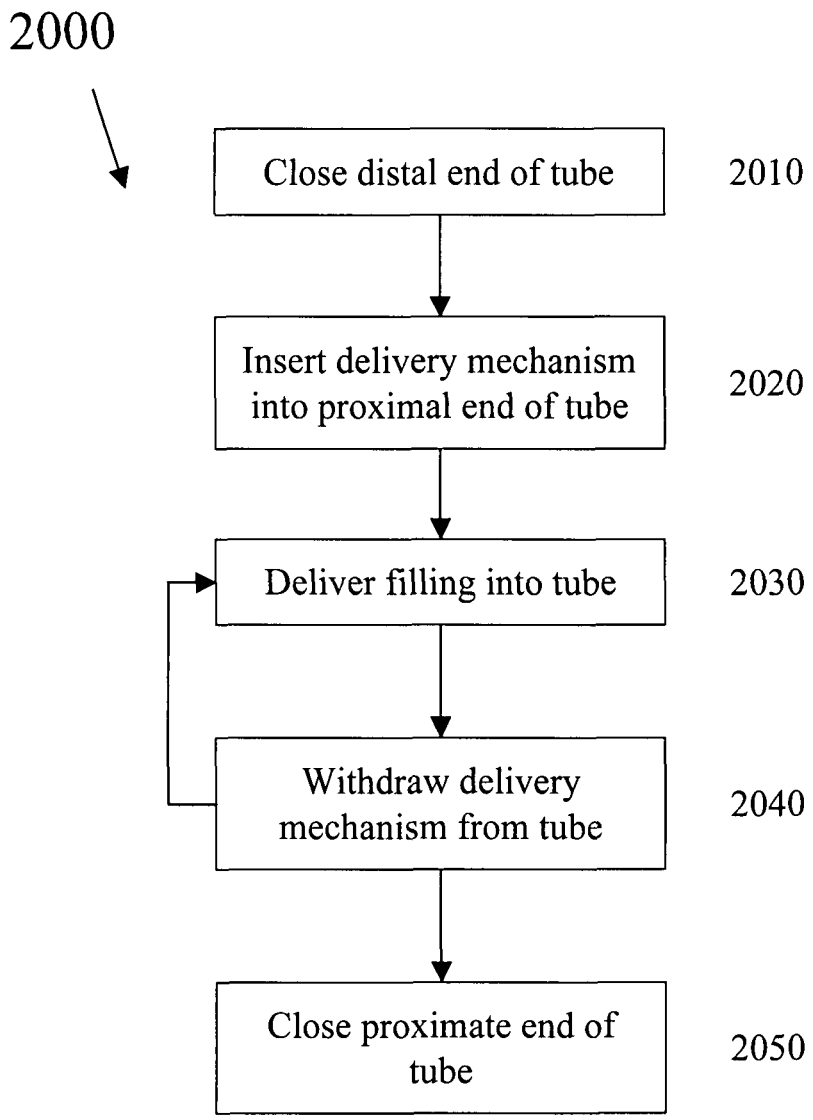
FIG. 2 is a flowchart of an embodiment of a method 2000 of the present invention.

FIG. 1 is a block diagram of an exemplary embodiment of a system 1000 of the present invention. System 1000 can include a filling 1010, which can be contained in a storage enclosure 1020 and delivered via a delivery mechanism 1030 to a mesh tube 1040.

Filling 1010 can include any of a number of materials, including compost, composted organic materials, organic feedstocks, composted products, mulch, wood shavings, alum, lime, clay, pea gravel, gravel, sand, soil, wood chips, bark, peat, soil blends, straw, hay, leaves, sawdust, paper mill residuals, wood wastes, wood pellets, hemp, bamboo, biosolids, coconut fibers, coir, wheat straw, rice straw, rice hulls, oat straw, soybean hulls, palm wastes, palm leaves, agricultural waste products, manure, wool, hair, sugar cane bagasse, seed hulls, jute, flax, hulls, organic waste, cat litter, plant seeds, plugs, sprigs, and/or spores, etc.

Certain embodiments of filling 1010, such as compost, can provide treatment of runoff water by physically straining the runoff; biologically degrading unwanted, harmful, and/or polluting substances; and/or chemically binding certain pollutants, such as metals (e.g., arsenic, cadmium, chromium, cobalt, copper, lead, mercury, nickel, and/or selenium), hydrocarbons, and/or organic chemicals (such as 2,4,6-trinitrotoluene), and/or nutrients (such as fertilizer, nitrates, phosphates, sewage, and/or animal waste).

Certain embodiments of filling 1010, such as compost, can be weed seed-free, disease-free, and/or insect-free, and can be derived from a well-decomposed source of organic matter. Certain embodiments of such compost can be free of refuse, contaminants, and/or other materials toxic and/or deleterious to plant growth. In certain embodiments, the compost can have a pH that measures anywhere between approximately 5.0 and approximately 8.0. Certain embodiments of such compost can be produced according to an aerobic composting process meeting 40 CFR 503 regulations. Certain embodiments of such compost can have a moisture content of less than 60%.

In certain embodiments, such as perhaps those involving water filtration, the particle size of the compost can conform to the following: 99% passing a 1 inch sieve, 90% passing a 0.75 inch sieve, a minimum of 70% greater than a 0.375 inch sieve, and/or less than 2% exceeding 3 inches in length.

In certain embodiments, such as those use for creating a plant growing environment, the minimum particle size can be eliminated, thereby effectively ensuring that some fines will remain that can help vegetation become established.

Certain embodiments of such compost, such as those used for sediment control, can contain less than 1% by dry weight of inert, foreign, and/or man-made materials. Certain embodiments of such compost can have predetermined materials added thereto.

For example, certain embodiments of filling 1010 can include, support, and/or encompass one or more microorganisms, microflora, rhizospheres, mycospheres, and/or ecosystems that can biologically and/or chemically break-down, decompose, degrade, bind, and/or filter unwanted pollutants in the water that flows therethrough.

Certain embodiments of filling 1010 can include entities such as colonies, spores, seeds, bulbs, plugs, sprouts, sprigs, and/or seedlings of microorganisms, bacteria, fungi, and/or plants. As these entities become established, these entities can provide numerous beneficial functions.

For example, certain living entities can assist with remediating the environmental impact of the expected effluent. For example, plants commonly called cattails, reeds, rushes and/or skunk cabbage can be useful for treating certain types of sewage. Thus, for example, a potential wetland area downstream of a septic field could be surrounded and/or filled with a filled tubes seeded with an appropriate variety of plant.

As another example, certain plants, such as mustard, can be useful for absorbing particular heavy metals. As yet another example, the root systems of plants growing from a filled tube can serve to anchor the filled tube into the adjacent soil. This anchoring can serve to prevent run-off from moving or washing away the filled tube.

As a further example, certain embodiments of the filled mesh tube can eventually provide plants can improve the aesthetic image of the filled tube. Thus, rather than permanently presenting a black, brown, or gray-colored compost-filled tube, a sprouted filled tube can present, for example, blooming flowers, groundcovers, vines, shrubs, grasses (such as turn seed, annual rye, crown vetch, birds foot trefoil, and/or fescues), and/or aquatic plants, etc.

As another example, via a technique called mycoremediation, certain fungi and/or fungal components, such as macrofungi (including mushrooms commonly referred to as shiitakes, portabellas, criminis, oysters, whites, and/or morels), white-rot fungi (such as *P. chrysosporium*), brown-rot fungi, mycelium, mycelial hyphae, and/or conidia, can be useful for decomposing and/or breaking down pollutants and/or contaminants, including petroleum, fertilizers, pesticides, explosives, and/or a wide assortment of agricultural, medical, and/or industrial wastes. Certain of such fungi and/or fungal components are available from Fungi Perfecti of Olympia, Wash.

In certain embodiments, a microbial community encompassed within the filling of the mesh tube can participate with the fungi and/or fungal components to break down certain contaminants to carbon dioxide and water. Certain wood-degrading fungi can be effective in breaking down aromatic pollutants and/or chlorinated compounds. They also can be natural predators and competitors of microorganisms such as bacteria, nematodes, and/or rotifers. Certain strains of fungi have been developed that can detect, attack, destroy, and/or inhibit the growth of particular bacterial contaminants, such as *Escherichia coli* (*E. coli*).

Certain embodiments of the filling can include one or more fertilizers, flocculants, chemical binders, and/or water absorbers, any of which can be selected to address a particular need and/or problem, such as to fertilize the growth of a predetermined plant species and/or to bind a predetermined chemical.

Storage enclosure 1020 can at least partially surround filling 1010, and can be a vessel, tank, hopper, truck, and/or pile, etc. Delivery mechanism 1030 can be a hose, tube, pipe, duct, and/or chute, and can include a mechanical and/or pneumatic component, such as an auger, vibrator, and/or fan, etc. for biasing filling 1010 toward and/or into mesh tube 1040. Moreover, delivery mechanism 1030 can be replaced with a manual approach, whereby a human places filling 1010 into mesh tube 1040. Delivery mechanism 1030 can include a nozzle, reducer, and/or hose adaptor that allows a standard hose (such as a hose having an approximately 4 or 5 inch diameter) to fill a larger and/or smaller diameter mesh tube.

Mesh tube 1040 can be fabricated from a flexible netting material, which can be woven, sewn, knitted, welded, molded, and/or extruded, etc. One source of netting material is Tipper Tie-net of West Chicago, Ill. The netting material can be biodegradable, and in certain embodiments, at a predetermined rate of biodegradation. Alternatively, the netting material can resist biodegradation. The netting material can be fabricated from cotton, burlap, hemp, plastic, biodegradable plastic, UV sensitive plastic, UV inhibited plastic, polyester, polypropylene, multi-filament polypropylene, polyethylene, LDPE, HDPE, rayon, and/or nylon.

The netting material can be of any diameter and/or thickness, ranging from approximately 0.5 mils to 30 mils, including approximately 0.5, 0.75, 1, 2, 3, 4, 5, 6, 7, 8, 9, 10, 12, 15, 18, 20, 22, 25, 28, and/or 30 mils. The netting material can be in any available mesh size (mesh opening), from a mesh as small as that of women's pantyhose, and including a nominal mesh opening of approximately: 0.001, 0.005, 0.010, 0.025, 0.050, 0.0625, 0.125, 0.25, 0.375, 0.5, 0.625, 0.75, 0.875, 1.0, 1.125, 1.25, 1.375, and/or 1.5 inches. The netting material can have any mesh opening pattern, including diamond, hexagonal, oval, round, and/or square, etc. Mesh tube 1040 can be fabricated in standard lengths, such as any of approximately 1, 2, 3, 4, 5, 6, 7, 8, 9, 10, 15, 20, 25, 50, 75, 100, 125, 150, 200, 250, 300, 400, and/or 500 foot lengths, any of which can be coupled together to form a continuous mesh tube of any size, including tubes as long as 1000, 2000, 3000, 4000, 5000, 7500, and/or 10,000 or more feet. Thus, certain lengths of filled mesh tubes can be intended to be portable, and other lengths of filled mesh tubes can be intended to be immobile.

Mesh tube 1040 can be filled completely or incompletely. When filled completely, mesh tube 1040 can be generally curvilinear, round, oval, or polygonal in longitudinal cross-section. If generally oval, mesh tube 1040 can have a major diameter ranging from approximately 3 inches to approximately 30 inches, including approximately 3, 4, 5, 6, 8, 10, 12, 14, 16, 18, 20, 22, 24, 26, 28, and/or 30 inches. Thus, the ratio of the length of mesh tube 1040 to its major diameter can be approximately 5, 6, 7, 8, 9, 10, 15, 20, 25, 30, 35, 40, 45, 50, 75, 100, 150, 200, 300, 400, and/or 500 or larger.

Mesh tube 1040 can have opposing longitudinal ends, the end nearest the delivery device called the proximal end 1042 and the end furthest the delivery device called the distal end 1044. Distal end 1044 can be closed and/or sealed prior to the delivery of filling 1010 into mesh tube 1040. After delivery of filling 1010 into mesh tube 1040, proximal end 1042 can be closed and/or sealed. The method of closing and/or sealing either of ends 1042, 1044 can include knitting, sewing, folding, welding, stapling, clipping, clamping, tying, knotting, and/or fastening, etc.

Attached to mesh tube 1040 can be an anchoring device 1046, such as a flap fabricated from mesh netting, such as that used to fabricate mesh tube 1040. Such a flap can range in dimensions with the size of the tube and/or the expected forces that might bear upon the tube. For example, an 8-inch diameter tube might have two 4-inch wide flaps that are made from the same mesh material as the tube, and that extend along the entire length of the tube. Stakes can be driven through each of these flaps and into the underlying substrate. This can secure both sides of the tube, and can create additional stability for the tube.

Alternatively, anchoring device 1046 can be fabricated from any fabric. In another alternative embodiment, anchoring device 1046 can be a string, rope, cable tie, sod stakes, re-bar, wood stakes, and/or wire, etc. attached to mesh tube 1040.

Mesh tube 1040 can be attached to a geo-surface, such as the ground, soil, sand, silt, sod, earth, dirt, clay, mud, peat, gravel, rock, asphalt, concrete, pavement, a streambed, a stream bank, a waterway bank, a pond bank, a ditch, a ditch bank, and/or a slope, etc. The means for attaching mesh tube 1040 can include an attachment device 1048 that protrudes through mesh tube 1040 and/or anchoring device 1046. As an example, a metal or wooden stake could be hammered through a mesh-anchoring device 1046 and into a ditch bed to secure a mesh tube across the flow path of a ditch to form a "ditch check". Such a ditch check can slow water flow, encourage the deposition of silt and/or sediment, and/or potentially encourage the growth of plants whose root systems can further discourage run-off and/or erosion.

In certain embodiments, a filled mesh tube can at least partially impede the flow of water into a storm water basin inlet, thereby potentially preventing clogging of the piping that drains the basin and/or filtering the water that enters the basin.

In certain embodiments, multiple mesh tubes 1040 can be stacked, thereby forming a wall. Uphill from the tubes can be placed and/or backfilled, in some cases pneumatically, a geo-surface material and/or media, such as soil, sod, earth, dirt, clay, mud, peat, gravel, rock, and/or a filling material, as described earlier. Such a geo-surface material can be used to restore an eroded zone, such as when a stream bank has eroded beneath existing trees, exposing the trees and making them vulnerable to toppling. By installing multiple mesh tubes as a form of retaining wall, and back-filling with suitable material for supporting the tree and/or sustaining the tree's previously-exposed roots, the stream bank can be restored and the tree can potentially be saved.

Method 2000

Certain exemplary embodiments of the present invention can employ a method 2000 for forming a storm water control system, erosion control system, sediment control system, silt reduction system, soil retention system, water protection system, water filtration system, pollution remediation system, plant protection system, plant initiation system, and/or erosion remediation system.

The method can include numerous activities. For example, at activity 2010, a distal end of a mesh tube can be closed and/or sealed, such as by typing a knot in the tube. At activity 2020, a delivery mechanism, such as a blower hose or an auger outlet, can be inserted into an open proximate end of the mesh tube.

Alternatively, a mesh tube having open ends can be slid over a blower hose, and then an end of the tube can be closed and/or sealed.

At activity 2030, a filling can be discharged from the delivery mechanism into the mesh tube. The filling can be supplied to the delivery mechanism by, for example, a blower truck that contains a supply of the filling and is coupled pneumatically to the blower hose. Such blower trucks can include a pneumatic blower mounted on a portable truck that can be capable of reaching remote areas. A typical blower truck can blow filler down a hose of up to 700 feet in length, and can be obtained from Express Blower, Rexius, Finn, and/or Blotech.

As another example, a hopper can drop the filling into an auger that conveys the filling into the mesh tube. Activity 2030 can occur anywhere. That is, the mesh tube can be filled off-site ("ex-situ") and/or on-site ("in situ"), which can include at the ultimate desired location for the filled tube.

At activity 2040, the delivery mechanism can be withdrawn from the mesh tube when the mesh tube has been filled to the desired level. At activity 2050, the proximate end of the mesh tube can be closed and/or sealed. Alternatively, the filled tube can be attached to a second tube in a process called sleeving, in which one tube overlaps the other by about 2 to 4 feet, thereby effectively extending the length of the first tube. If needed, the two tubes can be attached together using, for example, twist ties, zip ties, or the like. Then the filling process can continue. Additional tubes can be further attached to form a continuous tube of any desired length.

It should be understood that the preceding is merely a detailed description of one or more exemplary embodiments of this invention and that numerous changes to the disclosed embodiments can be made in accordance with the disclosure herein without departing from the spirit or scope of the invention. The preceding description, therefore, is not meant to limit the scope of the invention. Rather, the scope of the invention is to be determined only by the appended claims, every element of which can be replaced by any one of numerous equivalent alternatives without departing from the spirit or scope of the invention, only some of which equivalent alternatives are disclosed in the specification.

What is claimed is:

1. A method for pneumatically forming an erosion control device comprising:

closing a distal end of a mesh tube formed from a mesh material having a opening size of between approximately 0.125 inches and approximately 0.5 inches, a ratio of a length of the mesh tube to a diameter of the mesh tube greater than 40, an external surface of said mesh tube formed by said mesh material;

inserting a pneumatic blower hose into an open proximate end of the mesh tube;

pneumatically discharging a filling from the pneumatic blower hose into the mesh tube;

withdrawing the pneumatic blower hose from the mesh tube; and closing the open proximate end of the mesh tube.

2. The method of claim 1, wherein said filling includes mulch.

3. The method of claim 1, wherein said filling includes wood shavings.

4. The method of claim 1, wherein said filling includes gravel.

5. The method of claim 1, wherein said filling includes wood chips.

6. The method of claim 1, wherein said filling includes bark.

7. The method of claim 1, wherein said filling includes hay.

8. The method of claim 1, wherein said filling includes leaves.

9. The method of claim 1, wherein said filling includes wood pellets.

10. The method of claim 1, wherein said filling includes bamboo.

11. The method of claim 1, wherein said filling includes palm wastes.

12. The method of claim 1, wherein said filling includes palm leaves.

13. The method of claim 1, wherein said filling includes wool.

14. The method of claim 1, wherein said filling includes hair.

15. The method of claim 1, wherein said filling includes sugar cane bagasse.

16. The method of claim 1, wherein said filling includes jute.

17. The method of claim 1, wherein said filling includes hulls.

18. The method of claim 1, wherein said filling includes flocculants.

19. The method of claim 1, wherein said filling includes chemical binders.

20. The method of claim 1, wherein said filling includes a water absorbent.

21. A method for pneumatically forming an erosion control device comprising:

pneumatically discharging a filling from a blower hose into a first mesh tube, the first mesh tube formed from a mesh material having a opening size of between approximately 0.125 inches and approximately 0.5 inches, a ratio of a length of the first mesh tube to a diameter of the first mesh tube greater than 40, an external surface of said mesh tube formed by said mesh material.

22. The method of claim 21, further comprising:

inserting said blower hose into an open proximate end of the first mesh tube.

* * * * *